US007765618B2

(12) United States Patent
Egglesfield

(10) Patent No.: US 7,765,618 B2
(45) Date of Patent: Aug. 3, 2010

(54) CLOTHING WITH DETACHABLE SYMBOLS

(76) Inventor: Colin Egglesfield, 11957 Goshen Ave. #402, Los Angeles, CA (US) 90049

( * ) Notice: Subject to any disclaimer, the term of this patent is extended or adjusted under 35 U.S.C. 154(b) by 0 days.

(21) Appl. No.: 12/573,734

(22) Filed: Oct. 5, 2009

(65) Prior Publication Data

US 2010/0017932 A1 Jan. 28, 2010

Related U.S. Application Data

(63) Continuation-in-part of application No. 11/674,762, filed on Feb. 14, 2007, now abandoned.

(51) Int. Cl.
*A41D 27/08* (2006.01)

(52) U.S. Cl. ..... 2/244

(58) Field of Classification Search ..... 2/244, 2/115, 80, 126; 40/586, 636, 329
See application file for complete search history.

(56) References Cited

U.S. PATENT DOCUMENTS 3,484,974 A * 12/1969 Culmone ..... 40/586
4,249,268 A * 2/1981 Berler ..... 2/115
4,354,282 A * 10/1982 Langdon ..... 2/115
4,611,355 A * 9/1986 Galanto et al. ..... 2/246
4,621,441 A * 11/1986 Wagner et al. ..... 40/636
4,710,979 A * 12/1987 Bull et al. ..... 2/48
4,776,043 A * 10/1988 Coleman ..... 2/209.12
4,873,726 A * 10/1989 Tapia ..... 2/195.1
5,016,285 A * 5/1991 Just ..... 2/114
5,052,056 A * 10/1991 Braun ..... 2/115
5,136,726 A * 8/1992 Kellin et al. ..... 2/244
5,149,388 A * 9/1992 Stahl ..... 156/250
5,367,795 A * 11/1994 Iverson et al. ..... 36/136
5,477,629 A * 12/1995 Gleason, Jr. ..... 40/329
5,509,144 A * 4/1996 Soergel et al. ..... 2/195.1
5,542,122 A * 8/1996 Moldovan ..... 2/69
5,718,589 A * 2/1998 McCracken et al. ..... 434/159
5,734,991 A * 4/1998 Schmid ..... 2/69
5,740,557 A * 4/1998 Reid et al. ..... 2/209.13
5,794,267 A * 8/1998 Wallace ..... 2/227
5,800,900 A * 9/1998 Mitchell ..... 428/100
5,803,266 A * 9/1998 Blackwelder ..... 206/575
5,809,669 A * 9/1998 Hage et al. ..... 36/127
5,845,334 A * 12/1998 Marcolini, Jr. ..... 2/69
5,933,866 A * 8/1999 Fox ..... 2/115

(Continued)

*Primary Examiner*—Alissa L Hoey
(74) *Attorney, Agent, or Firm*—Patent Authority LLC; Elliot Furman

(57) ABSTRACT

An article of clothing comprises four layers. A first layer of fabric is in the form of a wearable garment. A second layer of synthetic tricot fabric is attached to the first layer. A third layer of foam has the same shape and size as the second layer, is aligned with the second layer, and is heat fused to a horizontal fiber size of the tricot fabric. A fourth layer of loop material has the same shape and size as the third layer, is aligned with the third layer, has two sides both of which comprise nylon loops, and is heat fused to the fourth layer. A display item of a plurality of display items has a substantially smooth front portion and a back portion having a plurality of hooks. The display items are attachable and rearrangeable by joining the plurality of hooks to the loops of the fourth layer.

11 Claims, 6 Drawing Sheets

U.S. PATENT DOCUMENTS 5,943,697 A * 8/1999 Poskanzer ..... 2/69
5,957,692 A * 9/1999 McCracken et al. ..... 434/159
5,974,997 A * 11/1999 Amburgey ..... 112/475.01
6,339,866 B1 * 1/2002 French ..... 24/306
6,385,776 B2 * 5/2002 Linday ..... 2/171.1
6,397,390 B1 * 6/2002 Henderson et al. ..... 2/69
6,519,779 B1 * 2/2003 Taguchi ..... 2/209.12
6,782,554 B1 * 8/2004 Froehlich ..... 2/69
6,982,115 B2 * 1/2006 Poulos et al. ..... 428/195.1
7,132,144 B2 * 11/2006 Roberts ..... 428/40.2
7,296,999 B2 * 11/2007 Webber ..... 434/168
7,467,418 B2 * 12/2008 Kronenberger ..... 2/1
2001/0016958 A1 * 8/2001 Linday ..... 2/10
2003/0188469 A1 * 10/2003 Torres ..... 40/586
2003/0221244 A1 * 12/2003 Liddell ..... 2/244
2004/0006814 A1 * 1/2004 Holden ..... 2/455
2004/0068778 A1 * 4/2004 Van Veghel et al. ..... 2/244
2005/0044610 A1 * 3/2005 Grimes ..... 2/244
2007/0094774 A1 * 5/2007 Focht ..... 2/244
2007/0186327 A1 * 8/2007 Hall et al. ..... 2/69
2007/0294806 A1 * 12/2007 Harazi ..... 2/244
2008/0189830 A1 * 8/2008 Egglesfield ..... 2/244
2009/0178180 A1 * 7/2009 Harris ..... 2/244
2009/0260123 A1 * 10/2009 Swift ..... 2/69
2010/0058510 A1 * 3/2010 Vithlani ..... 2/69
2010/0058511 A1 * 3/2010 Lee ..... 2/69
2010/0095571 A1 * 4/2010 James ..... 40/586

* cited by examiner

CLOTHING WITH DETACHABLE SYMBOLS

This application is a continuation-in-part of U.S. patent application Ser. No. 11/674,762, filed Feb. 14, 2007, which is hereby incorporated by reference.

BACKGROUND

Clothing such as t-shirts with messages printed on them are very common. The printed messages may be, for example, ideological, social or political statements, catchy phrases to draw attention, motivational statements, or proverbs. Further, the printed messages may help persons to express their feelings, their mood, their identity, or their membership to a group. A printed message may become too often used, uninteresting, or obsolete with time and the person may want clothing having a message that suits a different or current situation.

In the prior art, the use of detachable and rearrangeable insignia that include alphabets, pictures, symbols, and the like enables the person to create and display a desired message on the clothing, and vary the message with time. In the prior art, the insignia contains a hook portion on its back portion and a printed area on its front portion. The clothing includes a loop portion. The insignia are attached to the clothing using a hook-and-loop fastener system.

However, prior art clothing with detachable insignia suffer from many limitations. For example, the loop portion is less soft and less flexible as compared to fabric of the clothing. Also, the loop portion does not blend easily with the fabric of the clothing, thereby making the clothing less comfortable to wear and less appealing to sight. Additionally, the loop portion is sewn onto the fabric of the clothing with simple stitching causing the loop portion to display stiff and pointed edges that are both uncomfortable and unsightly. And, the loop portion becomes susceptible to breaking due to the repeated application and removal of the insignia. Further, the ink of the printed area on the front portion of the insignia can rub off or fade over time with repeated use.

Thus, there is need for an improved article of clothing with detachable symbols.

SUMMARY

An article of clothing with detachable and rearrangeable display items comprises four layers. The first layer comprises a fabric in the form of a wearable garment. The second layer comprises a synthetic tricot fabric having a first side having vertical fibers running vertically and a second side having horizontal fibers running horizontally. The second layer is attached to the first layer such that the first vertical fiber side of the tricot fabric is facing the first layer of fabric and the second horizontal fiber side of the tricot fabric is facing away from the first layer of fabric. The third layer comprises foam having the same shape and size as the second layer and aligned with the second layer. The third layer is heat fused to the second horizontal fiber side of the synthetic tricot fabric. The fourth layer comprises a loop material having the same shape and size as the third layer and aligned with the third layer. The fourth layer has two sides, both of which comprise nylon loops. One side of the fourth layer is heat fused to the third layer and the other side of the fourth layer faces away from the first layer. A plurality of display items have a front portion this is substantially smooth, and a back portion having a plurality of hooks. The plurality of display items are attachable and rearrangeable by joining the plurality of hooks to the loops of the fourth layer, wherein the substantially smooth front portion faces away from the first layer of fabric when attached to the fourth layer.

DETAILED DESCRIPTION

Figure 1A:
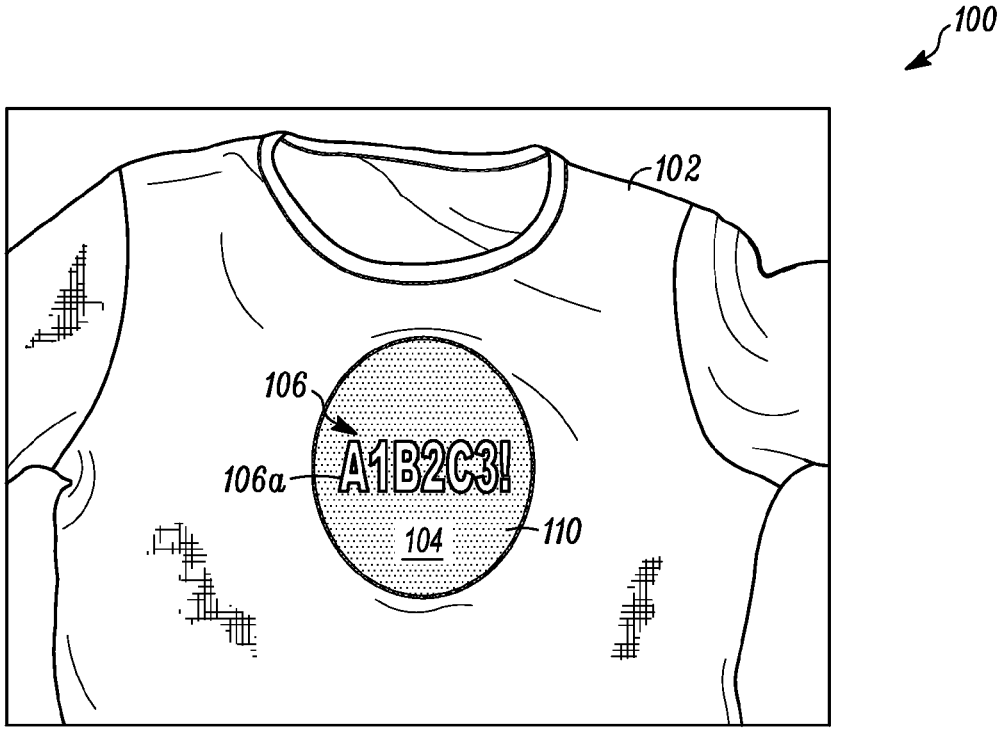
FIG. 1A illustrates an article of clothing.
Figure 1B:
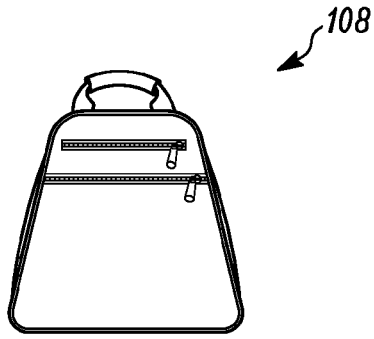
FIG. 1B illustrates a bag to carry the display items.
Figure 1C:
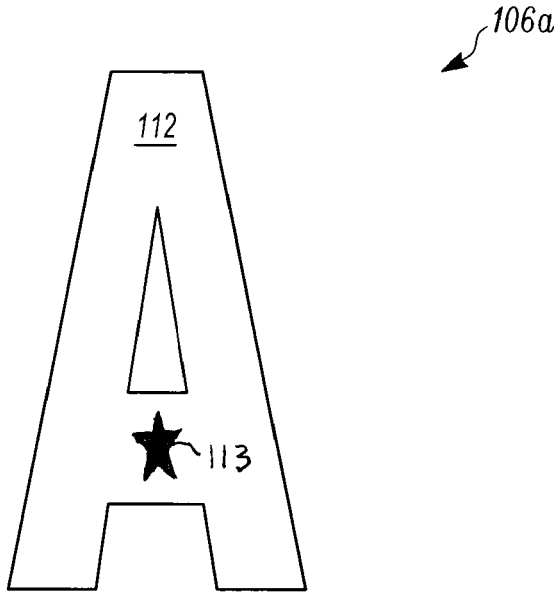
FIG. 1C illustrates a front view of an exemplary display item, including a decoration.
Figure 1D:
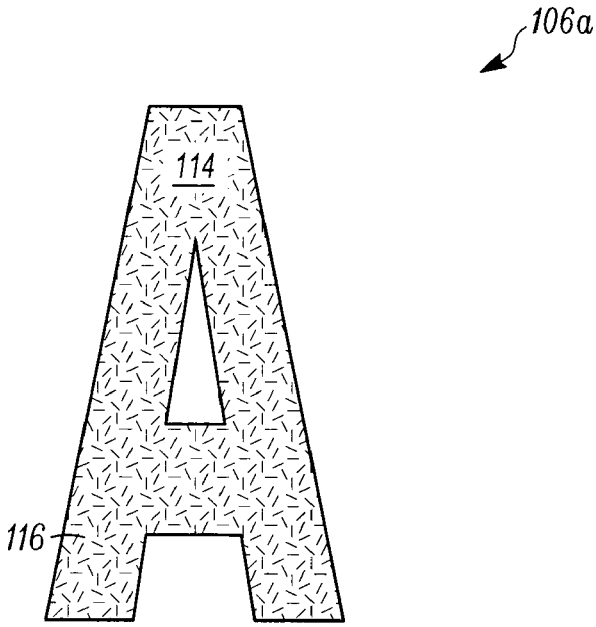
FIG. 1D illustrates a back view of the exemplary display item.

FIGS. 1A-1G show an article of clothing 100. The article of clothing 100 comprises four layers. The article of clothing 100 may also include a bag 108 to carry a plurality of display items 106. Display items 106 are removeably attached to the article of clothing at portion 104 using a hook-and-loop fastener. A display item 106*a* includes a front portion 112 (FIG. 1C) and a back portion 114 (FIG. 1D).

Figure 2:
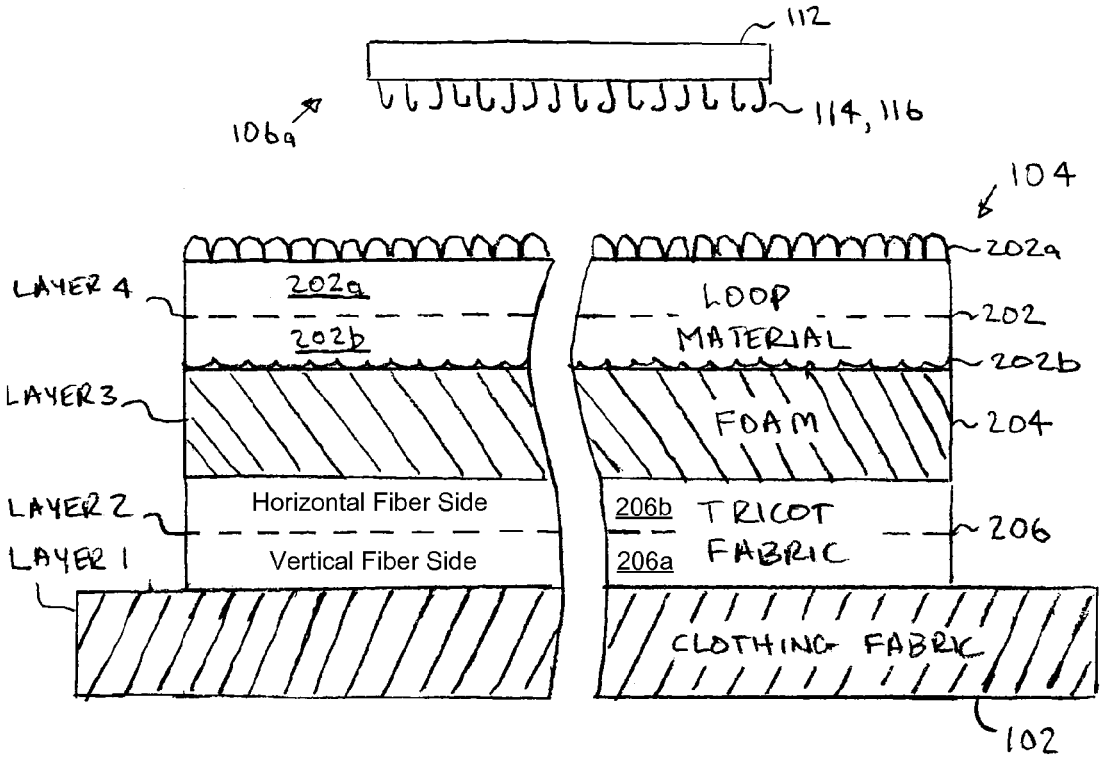
FIG. 2 illustrates a cross sectional view of the article of clothing and the display item.

FIG. 2 shows a cross sectional view of the article of clothing and the display item. The article of clothing comprises:

Layer 1: The shirt (102);

Layer 2: Lining of tricot fabric connected over the shirt layer (206);

Layer 3: Foam fused with and over the tricot fabric (204); and

Layer 4: Loop material fused with and over the foam (202).

This four layer construction is new, useful, and non-obvious, possessing non-obvious advantages over any prior art, including that it is more comfortable, and more durable, and better able to stand up to repeated washing cycles and repeated use. These superior properties arise out of the unique structure and materials set forth herein. The unique structure and materials were discovered after recognizing the problems of the prior art, and not through routine experimentation.

Referring to FIG. 2 to examine the layers more closely, layer 2 comprises a synthetic tricot fabric 206. The function of this lining layer is to provide a low friction boundary between the shirt 102 and the foam layer 204. The reduced friction is critical to the longevity of the shirt because without the lining layer 206, the foam 204 and shirt 102 continuously rub against one another when the shirt is washed, put on to wear, taken off, or generally moved around through the day. This movement or rubbing is generally in the vertical direction, for example when the shirt is put on or taken off. As those skilled in the art can appreciate, foam easily disintegrates through repeated mechanical agitation (such as washing, rubbing, etc.). Layer 2 substantially eliminates the problem of foam disintegration.

Synthetic tricot fabric is critical because synthetic fibers such as nylon tend to be smooth, and tricot fabric is a close knit design with fibers running vertically lengthwise on one side of the fabric, and fibers running horizontally lengthwise on the other side of the fabric. Accordingly, the feel of the tricot fabric is very smooth along the length of the fibers; one side is very smooth in the vertical direction and the other side is very smooth in the horizontal direction. The smoothness directly correlates with the amount of friction between the second layer and the first layer when the tricot fabric is rubbed or moves against the material of the first layer; the smoother the fabric, the lower the friction.

As can be seen in FIG. 2, the lining layer 206 of layer 2 is connected (for example, sewn) to the clothing fabric layer 102 of layer 1 such that the first vertical fiber side 206*a* of the tricot fabric is facing the first layer of fabric 102 (e.g. shirt) and the second horizontal fiber side 206*b* of the tricot fabric is facing away from the first layer 102 of fabric (i.e. towards the foam 204). FIGS. 1A, 1E, 1F, and 1G, attempt to further demonstrate this specific arrangement, wherein the vertical dotted lines of portion 104 signify the vertical alignment of the lining layer 206*a* in relation to the garment layer 102.

Concisely, the second layer 206 comprises a synthetic tricot fabric 206 having a first side having vertical fibers 206*a* running vertically, and a second side having horizontal fibers 206*b* running horizontally. The second layer 206 is sewn to the first layer 102 such that first vertical fiber side 206*a* of the tricot fabric 206 is facing the first layer of fabric 102, and the second horizontal fiber side 206*b* of the tricot fabric 206 is facing away from the first layer of fabric 102.

As to layer 3, the foam 204 is heat fused or laminated to the tricot fabric lining layer 206. Specifically the third layer of foam 204 has the same shape and size as the second layer 206 and is aligned with the second layer 206. The third layer 206 is heat fused to the second horizontal fiber side 206*b* of the synthetic tricot fabric 206.

By connecting the foam 204 and lining layer 206 in this manner, all motion or friction between the foam and lining is eliminated since the entire surface of the foam 204 is connected to the entire surface of the lining layer 206 via, for example, an adhesive. Thus, disintegration of the foam 204 is eliminated and the longevity of the shirt is greatly increased.

The foam layer 204 provides padding between the fourth layer 202 of loop material and the person wearing the shirt. The padding is important because the hook portion 114 of the letters 106*a* are pressed onto the loops 202*a* of the loop material 202, and the hooks 114 are stiff and, without the foam 204, can pass through all four layers 202, 204, 206, and 102, past the fabric layer 102, and irritate the skin of person wearing the article of clothing 100. It is also important because, even if the hooks 114 do not poke through past the fabric layer 102, it is more comfortable to the wearer if there is some padding when the display items 106*a* are pressed onto the loop layer 202 since this helps absorb the pressure applied by a finger or hand when applying the display items 106*a*. Also, if the loop layer 202 has a stiff side and a soft loop side (see next paragraph), the padding is particularly critical in providing comfort to the wearer; stiff plastics are not comfortable to wear and are inflexible; the foam provides a comfortable padding barrier between the stiff loop backing and the person wearing the article of clothing.

As to layer 4 202, the loop material 202 is heat fused to the foam layer 204 thus eliminating disintegration of the foam due to repeated mechanical agitation or friction. The loop material 202 also has the same shape and size as the third layer 204 and it is aligned with the third layer 204.

Those skilled in the art will appreciate that one type of loop material 202 has a stiff nylon or plastic back to which the loops are attached. With reference to the foam 204, even if a stiff backed loop layer is selected as layer 4 202, the article of clothing 100 will still have superior properties over the prior art, as described above.

FIG. 2, however, shows a loop material 202 that has two sides, both sides have nylon loops 202*a* and 202*b*, and there is no stiff plastic base layer. Thus, the loop material 202 has a natural fabric feel by eliminating the stiff backing. Any natural, synthetic, or synthetic blend fabric having a looped pile can be used as the loop material 202. In this way, manufacturing the shirt is made more simple because the foam can be fused with either side of the loop material.

Concisely, the fourth layer 202 comprises a loop material having the same shape and size as the third layer 204 and is aligned with third layer 204. The fourth layer 202 has two sides, both of which comprise nylon loops 202*a* and 202*b*. One side 202*b* of the fourth layer 202 is heat fused to the third layer 204, and the other side 202*a* of the fourth layer 202*a* is facing away from the first layer 102.

Examining the display items 106*a*, each display item has a front smooth portion 112 to be displayed facing away from the shirt, and a back hook portion 114 to be attached to layer 4 202. Specifically, each display item 106*a* comprises a front portion 112 that is substantially smooth, and a back portion 114 having a plurality of hooks 116. The display item 106*a* is attachable and rearrangeable by joining the plurality of hooks 116 to the loops 202*a* of the fourth layer 202, wherein the front portion 112 faces away from the first layer 102 when attached to the fourth layer 202.

As already disclosed above, the second 206, third 204, and fourth 202 layers have the same shape and size, and are aligned. The equal size, shape, and alignment is important because if these layers did not have the same shape and size, or were misaligned, they would be more likely to separate or delaminate, thus diminishing some of the superior properties of the article of clothing. Also, they would be aesthetically unpleasing.

If layers 2, 3, and 4 (206, 204, and 202) are sewn to layer 1 102, they are sewn such that there are substantially no excess edges and margins. The absence of excess edges and margins results in improving the aesthetic appearance, as well as greatly reducing or eliminating the chance that the display portion can catch or snag on other clothing items, or be pulled loose during use or washing.

In one example, the layers have a generally round shape as shown in FIGS. 1A, 1E, 1F, 1G, 3A, and 3B. Other exemplary shapes include rectangular, circular, elliptical, polygonal, curved, arcuate, curvilinear, rectilinear, and arched. For example, the shape may be large and round to allow more space for placement of more display items 106 with a greater variety of messages.

Figure 3A:
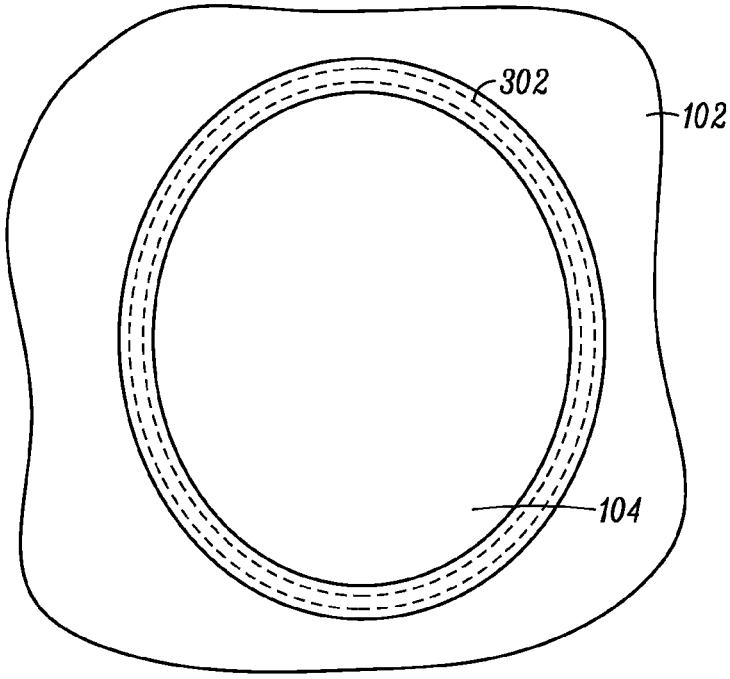
FIG. 3A illustrates double stitching to attach the display portion onto the clothing product.
Figure 3B:
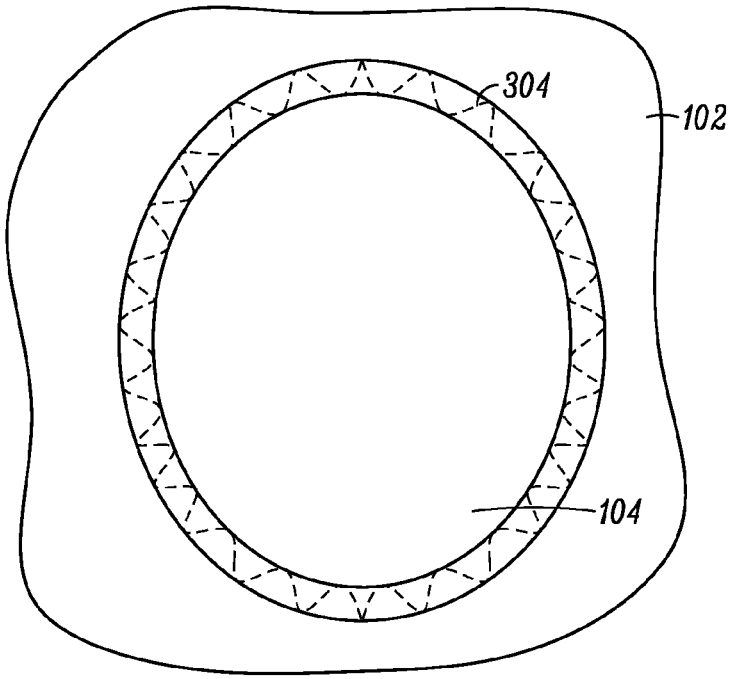
FIG. 3B illustrates zig-zag stitching to attach the display portion onto the clothing product.

FIGS. 3A and 3B show double stitching 302 and zig-zag stitching 304 respectively to attach equally sized and aligned layers 202, 204, and 206 onto layer 102. These layers may also be attached using a heat fusible layer, for example, by melting a heat fusible layer between layer 1 202 and layer 2 206. The heat fusible layer is melted under heat or pressure, or a combination of heat and pressure. Fusing layers of fabric is well understood by those having ordinary skill in the art. The heat fusible layer may be a heat activated adhesive. The heat fusible layer may be a fabric or mesh that melts under heat or pressure, or a combination of heat and pressure. Heat activated adhesives, fabrics, and meshes are well understood by those having ordinary skill in the art.

Layer 1 102 may be one of, but not limited to, caps, jackets, shirts, t-shirts, trousers, overalls, hats, long sleeve shirts, sweatshirts, sweatpants, and pants. The clothing layer 102 may be made of a material that includes at least one of cotton, nylon, polyester, and other fabrics and blends of fabrics. Layer 1 102 may also include decorations such as straps, printed image, and the like.

A bag 108 may be used to carry the display items 106 not attached to layer 4 202.

Each display item 106*a* is die-cut from a hook material. The hook material may include a material such as that sold under the trademark VELCRO. The display item 106*a* may be one of a letter or an alphabet such as A, B, C, a number such as 1, 2, 3, a symbol, a picture, a picture of a cartoon character, a word, a badge, a slogan, a text, an indicium, an insignia, a character, a logo, and combinations thereof The display item 106*a* is removeably attached to portion 104 by pressing the plurality of hooks 116 onto the plurality of loops 202*a*. The front portion 112 is visible 104 while the back portion 114 is attached to layer 4 202.

The color of the display item 106*a* is chosen based on the color of the display portion 104 and the available colors of the hook material. The color of the hook material may be selected based on the color of side 202*b* of layer 4 202 to obtain a desired brightness and contrast for better display. For example, side 202*b* of layer 4 202 may be black in color and the color of side 112 of display item 106*a* selected to be a light color such as white. The display item 106*a* is die-cut to provide it with an aesthetic look by providing the display item 106*a* with sharp edges and smooth sides, and also to ensure the edges of the display item withstand repeated and prolonged use. The display items 106 may be provided with a decorative pattern by printing. The display items 106 may have decorative layers sewn or glued onto them. The display items 106 may be provided with a fluorescent paint or dye that glows in dark. FIG. 1C also illustrates a decoration 113 connected to the front portion 112 of the display item 106*a*. In this example, the decoration 113 is a plastic charm in the shape of a star.

Figure 1E:
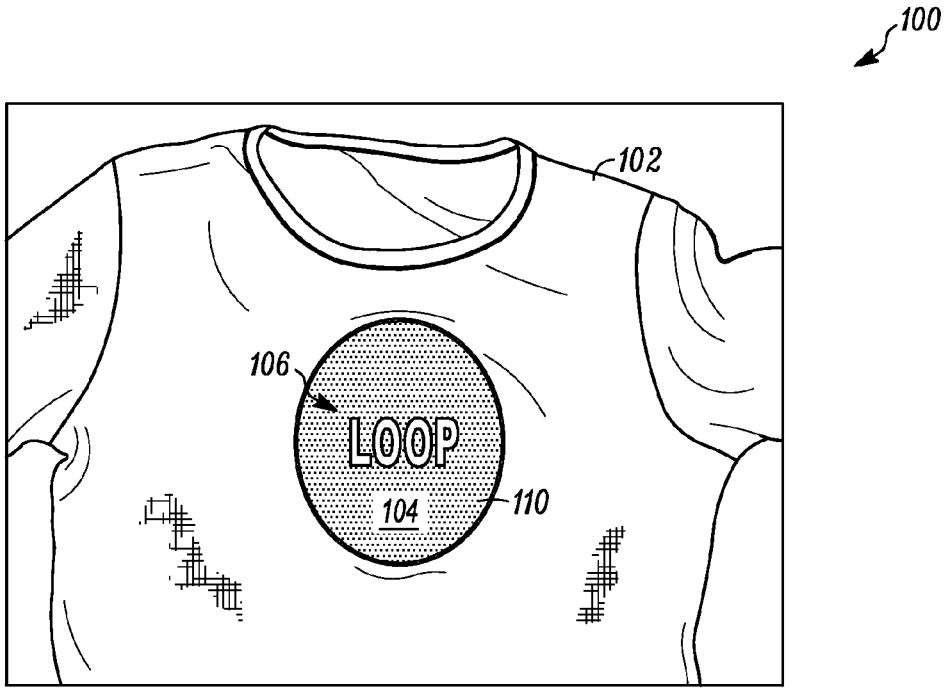
FIG. 1E illustrates an exemplary arrangement of display items.
Figure 1F:
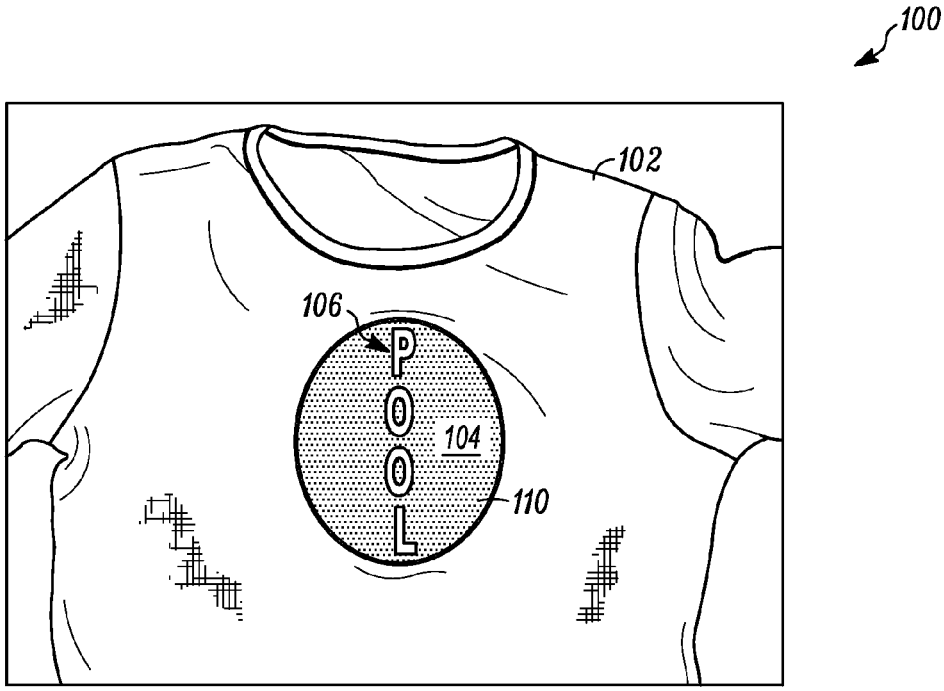
FIG. 1F illustrates an exemplary rearrangement of the display items.

The display items 106 may be detached and rearranged to form a desired message. For example, the display items 106 such as 'A', 'B', '1', '2', 'C', '3', and '!' are arranged on portion 104 of a t-shirt as shown in FIG. 1A. A user can select the display items 106 and customize the t-shirt as desired. The arrangement of the display items 106 can be changed to create different messages, phrases, etc. For exemplary purposes, FIGS. 1E and 1F depict one such rearrangement of the display items 106 on portion 104. FIG. 1E shows the formation of word 'LOOP', while FIG. 1F depicts the rearrangement of the same display items 106 to form a new word 'POOL'. Further, the orientation of this rearrangement of the display items 106 can also be changed. As shown in FIG. 1E, 'LOOP' is displayed in a horizontal direction, while in FIG. 1F 'POOL' is displayed in a vertical direction. It would be apparent to a person skilled in the art, that similar rearrangement could be done with numerals, symbols, characters, and any combination thereof Further, the rearrangement can be used to create different messages, phrases, etc.

A display item may be used to display a logo of a company. A display item may also be used to display at least one of a person's name, the name of a company, group, school, college, and the like. Further, the plurality of display items 106 may form a picture. The picture may be at least one of a movie actor, a historic monument, a cartoon character, and the like.

Figure 1G:
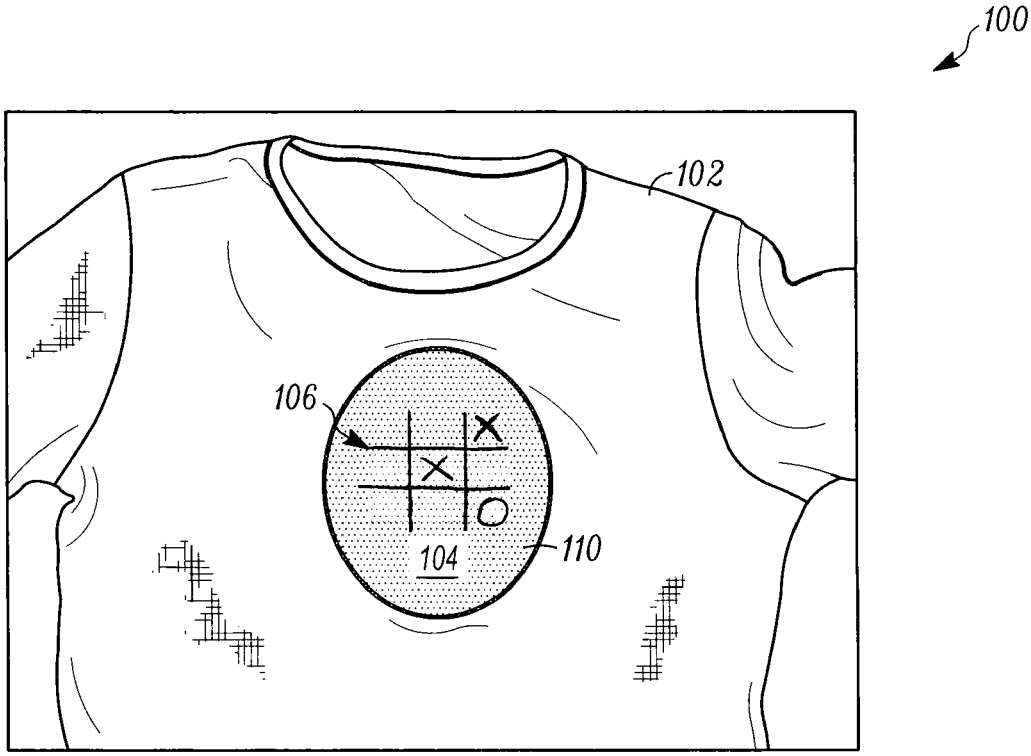
FIG. 1G illustrates display items attached to the fourth layer to form a playable puzzle or game.

The plurality of display items 106 may be attached to the fourth layer 202 to form a playable puzzle or, equivalently, a game. The puzzle may include a combination of different display portions having different shapes and/or colors. Side 202*b* of layer 4 202 may also comprise colored stitching, dyes, paints, and printing to further define the puzzle. FIG. 1G shows the display items 106 attached to the fourth layer 202 to form a game, in this case, tick-tack-toe.

In one use, a celebrity may use the article of clothing 100 to attract and interact with a crowd by displaying different messages. The article of clothing 100 may be used to display promotional materials or to advertise products.

The foregoing detailed description has set forth a few of the many forms that this invention can take. It is intended that the foregoing detailed description be understood as an illustration of selected forms that the invention can take and not as a limitation to the definition of the invention. It is only the following claims, including all equivalents that are intended to define the scope of this invention.

What is claimed is:

1. An article of clothing with detachable and rearrangeable display items and storage bag comprising:

a first layer of fabric in the form of a wearable garment;

a second layer of synthetic tricot fabric and having a first side having vertical fibers running vertically and a second side having horizontal fibers running horizontally, the second layer attached to the first layer such that the first vertical fiber side of the tricot fabric is facing the first layer of fabric and the second horizontal fiber side of the tricot fabric is facing away from the first layer of fabric;

a third layer of foam having the same shape and size as the second layer and aligned with the second layer, the third layer heat fused to the second horizontal fiber side of the synthetic tricot fabric;

a fourth layer of loop material having the same shape and size as the third layer and aligned with the third layer, the fourth layer having two sides both of which comprise nylon loops, one side of the fourth layer heat fused to the third layer and the other side of the fourth layer facing away from the first layer; and a plurality of display items having a front portion that is substantially smooth and a back portion having a plurality of hooks, the plurality of display items attachable and rearrangeable by joining the plurality of hooks to the loops of the fourth layer, wherein the substantially smooth front portion faces away from the first layer of fabric when attached to the fourth layer.

2. The article of claim 1 wherein the first layer of fabric comprises cotton.

3. The article of claim 1 wherein the second layer has a generally round shape.

4. The article of claim 1 wherein the second layer of synthetic tricot fabric comprises nylon.

5. The article of claim 1 wherein the display items are die cut.

6. The article of claim 1 further comprising decorations connected to the front portion of at least some of the display items.

7. The article of claim 1 wherein at least some of the plurality of display items are attached to the fourth layer such that they form a game or a puzzle.

8. The article of claim 1 wherein the second layer, third layer, and fourth layer is connected to the first layer such that there are substantially no excess edges or margins.

9. The article of claim 1 wherein the wearable garment is a shirt.

10. The article of claim 1 further comprising a bag to carry the plurality of display items.

11. An article of clothing with detachable and rearrangeable display items and storage bag comprising:

a first layer of cotton fabric in the form of a wearable garment;

a second layer of synthetic tricot fabric and having a first side having vertical fibers running vertically and a second side having horizontal fibers running horizontally, the second layer sewn to the first layer such that the first vertical fiber side of the tricot fabric is facing the first layer of cotton fabric and the second horizontal fiber side of the tricot fabric is facing away from the first layer of cotton fabric;

a third layer of foam having the same shape and size as the second layer and aligned with the second layer, the third layer heat fused to the second horizontal fiber side of the synthetic tricot fabric;

a fourth layer of loop material having the same shape and size as the third layer and aligned with the third layer, the fourth layer having two sides both of which comprise nylon loops, one side of the fourth layer heat fused to the third layer and the other side of the fourth layer facing away from the first layer;

a plurality of display items having a front portion that is substantially smooth and a back portion having a plurality of hooks, the plurality of display items attachable and rearrangeable by joining the plurality of hooks to the loops of the fourth layer, wherein the substantially smooth front portion faces away from the first layer of fabric when attached to the fourth layer; and a bag to carry the plurality of display items.

* * * * *